United States Patent [19]

Sugiyama et al.

[11] Patent Number: 5,014,562

[45] Date of Patent: May 14, 1991

[54] ENGINE STARTER WITH A SHORTENED OVER-RUNNING CLUTCH

[75] Inventors: Takeshi Sugiyama; Akira Morishita, both of Himeji, Japan

[73] Assignee: Mitsubishi Denki Kabushiki Kaisha, Tokyo, Japan

[21] Appl. No.: 487,507

[22] Filed: Mar. 2, 1990

[30] Foreign Application Priority Data

Mar. 3, 1989 [JP] Japan ..... 1-52262

[51] Int. Cl.[5] ..... F02N 11/00

[52] U.S. Cl. ..... 74/6; 74/7 R; 123/179 M

[58] Field of Search ..... 74/6, 7 R, 7 A, 7 B, 74/7 C; 123/179 M; 290/38 R, 38 C, 48

[56] References Cited

U.S. PATENT DOCUMENTS 4,304,140 12/1981 Ebihara ..... 74/7 R 4,720,639 1/1988 Sakayanagi et al. ..... 290/38 R

FOREIGN PATENT DOCUMENTS 2402081 4/1979 France ..... 74/7 A

*Primary Examiner*—Richard Lorence

*Assistant Examiner*—Scott Anchell

*Attorney, Agent, or Firm*—Sughrue, Mion, Zinn, Macpeak and Seas

[57] ABSTRACT

An engine starter motor comprising a d.c. motor having an armature rotary shaft 7 an over-running clutch 31 slidably mounted on the armature rotary shaft between a forward position and a rearward position and including a clutch inner cylinder 32, and a pinion 33 mounted on the clutch inner cylinder. In order to energize the d.c. motor and slide the over-running clutch together with the pinion between the forward and rearward positions, a solenoid switch 15 and a shift lever 34 are provided. The shift lever comprises a main body 34*a*, a first end portion 34*b* operatively coupled to the solenoid switch and a second end poriton operatively coupled to the over-running clutch. The second end of the shift lever is bifurcated into two tines 34*e* and each of the tines is provided with a forward extension 344 forwardly extending substantially parallel to the rotary shaft and an inwardly extending engagement projection 34*g* for engagement with the over-running clutch. The axial length of the forward extension is such that the engagement projection on the forward extension engages the clutch inner cylinder at a point forwardly remote from the main body of the shift lever by a distance substantially corresponding to the axial length component of the forward extension, whereby the clutch inner cylinder has an axial dimension decreased by a distance substantially equal to the axial length component of the forward extension.

2 Claims, 2 Drawing Sheets

ENGINE STARTER WITH A SHORTENED OVER-RUNNING CLUTCH

BACKGROUND OF THE INVENTION

This invention relates to an engine starter and, more particularly, to an engine starter in which an over-running clutch is moved by a shift lever.

FIG. 1 illustrates in sectional side view a conventional engine starter. The engine starter comprises a d.c. motor 1 having a yoke 2 to which a plurality of magnetic poles 3 are attached. A rear bracket 4 is secured to the rear end of the yoke 2, and a front bracket 5 is secured to the front end of the yoke 2. The rear bracket 4 and the front bracket 5 rotatably support the rotary shaft 7 of an armature 6 through rear and front bearings 8 and 9. The rear bracket 4 also supports a brush assembly 10. The front bracket 5 includes a mounting flange **5*a* which engages a mounting surface 20*a* of the engine casing 20 containing an engine ring gear 19. The mounting flange 5*a* is secured to the mounting surface 20*a* of the casing 20 through fastener bolts 5*c* (only one is shown in FIG. 1). The front bracket 5 also comprises a pinion case 5*d* which fits within an opening 21 formed in the mounting surface 20*a* of the engine casing 20 and has an inner circumference at a position 5*e* corresponding to the mounting surface 20*a* of the casing 20**.

Within the front bracket 5, an over-running clutch 11 is axially slidably mounted on the rotary shaft 7. The over-running clutch 11 includes a clutch inner member 12 on which a pinion 13 is integrally formed. Since the clutch inner member 12 is relatively long, two bearings **12*a* and 12*b* axially spaced apart from each other are disposed between the clutch inner member 12 and the rotary shaft 7. In order to limit the forward movement of the pinion 13 along the rotary shaft 7, a stopper 14 is disposed on the rotary shaft 7. A flange 11*a* defines a circumferential groove 11*b* between the flange 11*a* and the rear end surface 11*c* of the over-running clutch 11** for a purpose which will become apparent later.

The starter also comprises a solenoid switch 15 which, when actuated, magnetically attracts a plunger 16 to pull a hook 17 rearward. The hook 17 of the solenoid switch 15 is connected to one end of a shift lever 18 for connecting the solenoid switch 15 to the over-running clutch 11 for axially moving the over-running clutch 11 and the pinion 13 back and forth on the rotary shaft 7 between a rearward position shown by solid lines and a forward position shown by dot-and-dash lines in FIG. 1.

The shift lever 18 comprises an elongated main body **18*a*, a bifurcated first end portion 18*b* operatively coupled to the hook 17 of the plunger 16 of the solenoid switch 15, a pivot point 18*c* pivotally supported between the front bracket 5 and the yoke 2, and a bifurcated second end portion 18*d* operatively coupled to the over-running clutch 11. The second end 18*d* of the shift lever 18 has two tines having substantially circular ends 18*e* which operatively engage the annular groove 11*b* defined between the flange 11*a* and the rear end surface 11*c* of the over-running clutch 11**.

When the solenoid switch 15 is energized, the plunger 16 pulls the hook 17 rearwardly to cause the counterclockwise rotation of the shift lever 18 about the pivot point **18*c*. Then, the shift lever 18 causes the over-running clutch 11 to slide forward along the rotary shaft 7 to bring the pinion 13 on the clutch inner member 12 of the over-running clutch 11 from the rearward position shown by the solid lines to the forward position shown by the dot-and-dash lines, into engagement with the engine ring gear 19. Simultaneously with the forward movement of the pinion 13, movable contacts (not shown) on the plunger 16 of the solenoid switch 15 engage stationary contacts (not shown), whereby an electric power source is connected to the d.c. motor 1 to rotate the motor armature 6 which, through the pinion 13, causes the engine ring gear 19** to be driven to start the engine.

In the conventional engine starter as above described, the engagement opening 21 has a relatively small diameter D and a relatively long distance L between the mounting surface **20*a* of the engine casing 20 and the engine ring gear 19. Therefore, the inner circumference of the front bracket 5 has a relatively small diameter located close to the shift lever 18, so that the point at which the shift lever 18 is coupled to the over-running clutch 11 cannot be located deep within the pinion case 5*d* and the clutch inner member 12 of the over-running clutch 11 must have a relatively large axial dimension. The axially elongated clutch inner member or cylinder 12** requires a troublesome precision finishing of the inner surface and two bearings spaced apart from each other, thereby increasing the cost of the starter.

SUMMARY OF THE INVENTION

Accordingly, one object of the present invention is to provide an engine starter free from the above discussed problems of the conventional engine starter.

Another object of the present invention is to provide an engine starter in which the axial length of the clutch inner cylinder of the over-running clutch can be decreased.

Another object of the present invention is to provide an engine starter in which the manufacturing of the over-running clutch can be made easier.

Still another object of the present invention is to provide an engine starter in which the clutch inner cylinder of the over-running clutch can be effectively supported by a single bearing.

With the above objects in view, the engine starter of the present invention comprises a d.c. motor having an armature rotary shaft, an over-running clutch slidably mounted on the armature rotary shaft between a forward position and a rearward position and including a clutch inner cylinder, and a pinion mounted on the clutch inner cylinder. In order to energize the d.c. motor and slide the over-running clutch together with the pinion between the forward and rearward positions, a solenoid switch and a shift lever are provided. The shift lever comprises a main body, a first end portion operatively coupled to the solenoid switch and a second end portion operatively coupled to the over-running clutch. The second end of the shift lever is bifurcated into two tines, and each of the tines is provided with a forward extension forwardly extending substantially parallel to the rotary shaft and an inwardly extending engagement projection for engagement with the over-running clutch. The axial length of the forward extension is such that the engagement projection on the forward extension engages the clutch inner cylinder at a point forwardly remote from the main body of the shift lever by a distance substantially corresponding to the axial length component of the forward extension, whereby the clutch inner cylinder has an axial dimension decreased by a distance substantially equal to the axial length component of the forward extension, allowing the clutch inner cylinder to be supported by a single bearing.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
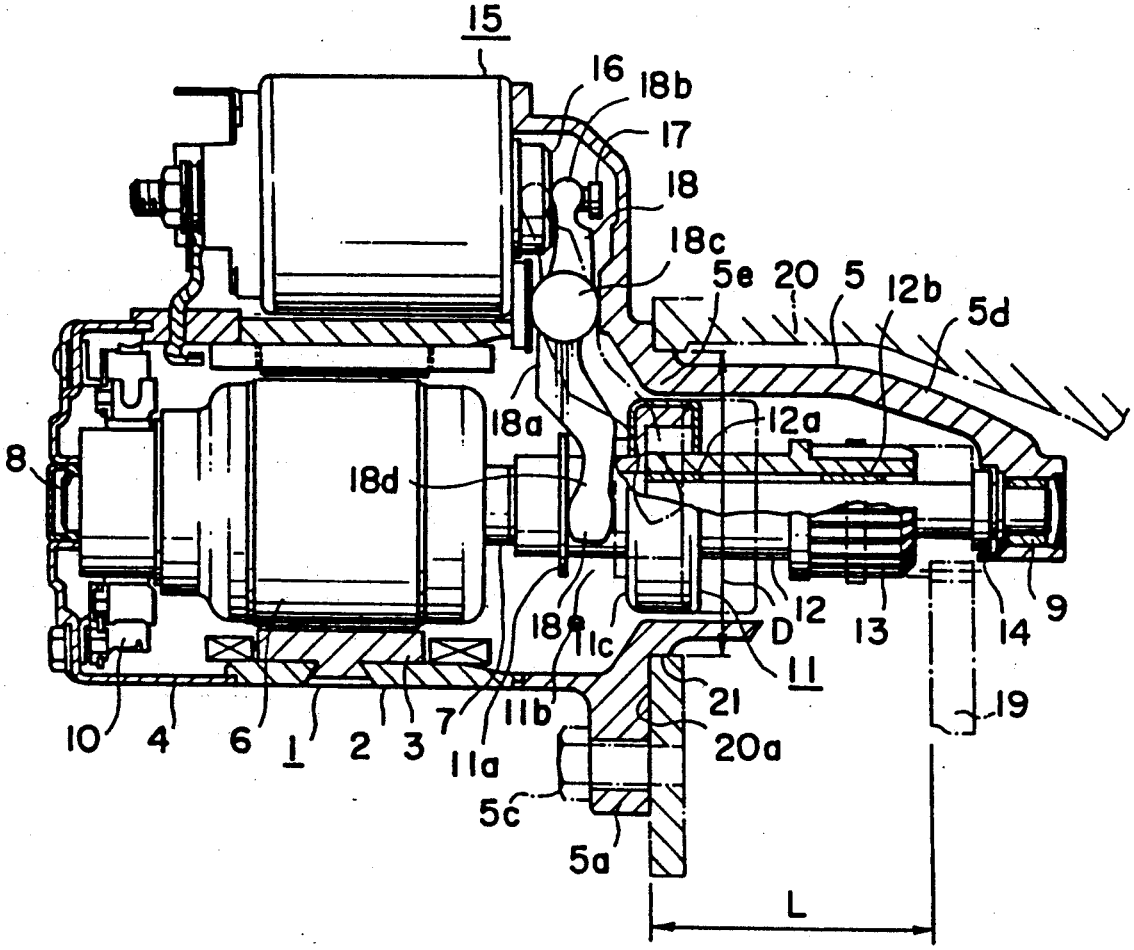
FIG. 1 PRIOR ART
FIG. 1 is a sectional side view of a conventional engine starter.
Figure 2:
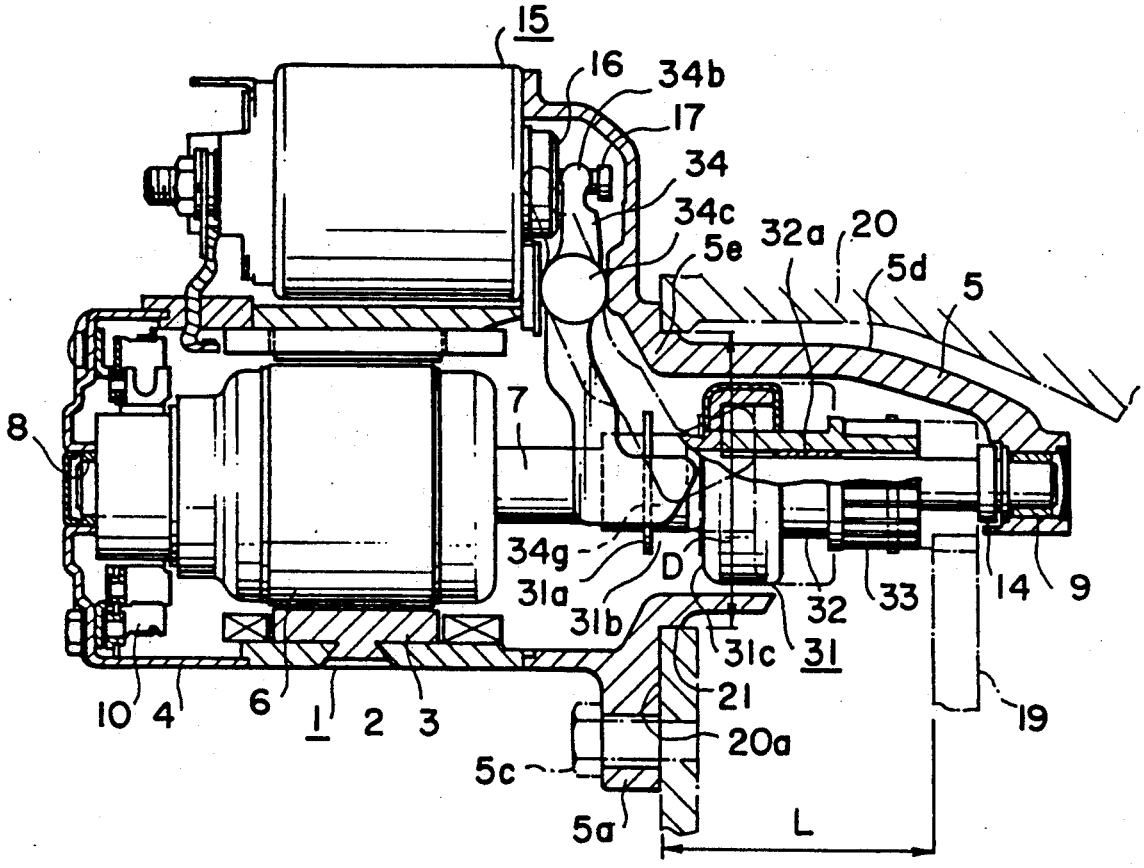
FIG. 2 is a sectional side view of an engine starter motor of the present invention.

FIG. 2 illustrates in a sectional side view an engine starter of the present invention. The engine starter has a basic sturucture similar to that of the conventional engine starter illustrated and described in conjunction with FIG. 1. More specifically, the engine starter of the present invention comprises a d.c. motor 1 having a yoke 2 to which a plurality of magnetic poles 3 are attached. A rear bracket 4 is secured to the rear end of the yoke 2, and a front bracket 5 is secured to the front end of the yoke 2. The rear bracket 4 and the front bracket 5 rotatably support the rotary shaft 7 of an armature 6 through rear and front bearings 8 and 9. The rear bracket 4 also supports a brush assembly 10. The front bracket 5 includes a mounting flange **5*a* which engages a mounting surface 20*a* of the engine casing 20 containing an engine ring gear 19. The mounting flange 5*a* is secured to the mounting surface 20*a* of the casing 20 through fastener bolts 5*c* (only one is shown in FIG. 1). The front bracket 5 also comprises a pinion case 5*d* which is a substantially cup-shaped member and fits within an opening 21 formed in the mounting surface 20*a* of the engine casing 20 and has an inner circumference at a position 5*e* corresponding to the mounting surface 20*a* of the casing 20**.

Within the cup-shaped pinion case **5*d* of the front bracket 5, an over-running clutch 31 is axially slidably mounted on the rotary shaft 7. The over-running clutch 31 includes a clutch inner member or cylinder 32 on which a pinion 33 is integrally formed. Since the clutch inner member 32 is relatively short, only one bearing 32*a* is disposed between the clutch inner member 12 and the rotary shaft 7 for a slidable and rotatable support. In order to limit the forward movement of the pinion 33 beyond a predetermined distance along the rotary shaft 7, a stopper 14 is disposed on the forward end of the rotary shaft 7. A flange 31*a* defines a circumferential groove 31*b* between the flange 31*a* and the rear end surface 31*c* of the over-running clutch 31** for a purpose which will become apparent later.

The starter also comprises a solenoid switch 15 which, when actuated, magnetically attracts a plunger 16 to pull a hook 17 rearward. The hook 17 of the solenoid switch 15 is connected to one end of a shift lever 34 for connecting the solenoid switch 15 to the over-running clutch 31 for axially moving the over-running clutch 31 and the pinion 33 on the rotary shaft 7 between a rearward position shown by solid lines and a forward position shown by dot-and-dash lines in FIG. 2.

Figure 3:
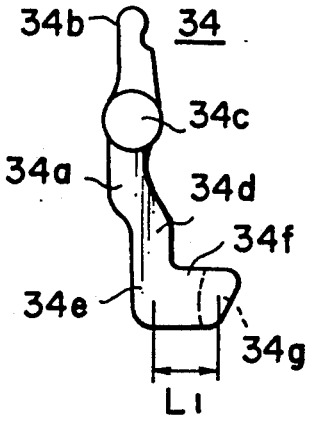
FIG. 3 is a side view of the shift lever of the present invention.
Figure 4:
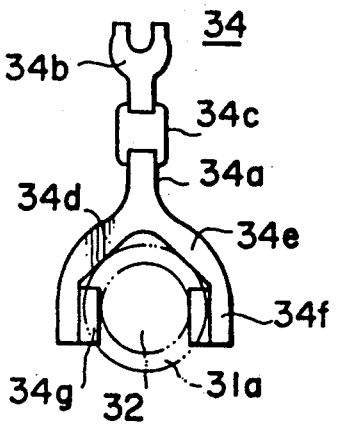
FIG. 4 is a front view of the shift lever illustrated in FIG. 3.

As best seen from FIGS. 3 and 4, the shift lever 34 comprises an elongated main body **34*a*, a bifurcated first end portion 34*b* operatively coupled to the hook 17 of the plunger 16 of the solenoid switch 15, a pivot point 34*c* pivotally supported between the front bracket 5 and the yoke 2, and a bifurcated second end portion 34*d* operatively coupled to the over-running clutch 31. The second end 34*d* of the shift lever 34 is bifurcated into two tines 34*e*, and each of the tines 34*e* is provided with a forward arm or extension 34*f* forwardly extending substantially parallel to the rotary shaft 7. Each of the forward extensions 34*f* is provided with an inwardly extending engagement projection 34*g* for engagement with the circumferential groove 31*b* defined between the flange 31*a* and the rear end surface 31*c* of the over-running clutch 31. The axial length of the forward extension 34*f* is such that the engagement projection 34 on the forward extension 34*f* engages the clutch inner cylinder 32 at a point forwardly remote from the main body 34*a* of the shift lever 34 by a distance substantially corresponding to the axial length component L1 of the forward extension 34*f*, whereby the clutch inner cylinder 32 is allowed to have an axial dimension decreased by a distance substantially equal to the axial length component L1 of the forward extension 34*f*, allowing the clutch inner cylinder 32 to be supported by a single bearing 32*a***.

When the solenoid switch 15 is energized, the plunger 16 pulls the hook 17 rearwardly to cause the counterclockwise rotation of the shift lever 34 about the pivot point **34*c*. Then, the shift lever causes the over-running clutch 31 to slide forward along the rotary shaft 7 to bring the pinion 33 on the clutch inner member of the over-running clutch from the rearward position shown by the solid lines to the forward position shown by the dot-and-dash lines into engagement with the engine ring gear 19. Simultaneously with the forward movement of the pinion 33, movable contacts (not shown) on the plunger 16 of the solenoid switch 15 engage stationary contacts (not shown), whereby an electric power source is connected to the d.c. motor 1 to rotate the motor armature 6 which, through the pinion, causes the engine ring gear 19** to be driven to start the engine.

In the engine starter as above described, the engagement opening 21 has a relatively small diameter D and a relatively long distance L between the mounting surface **20*a* of the engine casing 20 and the engine ring gear 19. Therefore, the inner circumference of the front bracket 5 has a relatively small diameter located close to the main body 34*a* of the shift lever 34. However, since the point at which the engagement projections 34*g* of the shift lever 34 couple to the circumferential groove 31*b* of the over-running clutch 31 is forwardly located by the distance L1 corresponding the length of the forward extensions 34*f*, the distance between the engine ring gear 19 and the engagement point at which the projections 34*g* engage with the over-running clutch 31 can be expressed as L–L1. Therefore, the clutch inner cylinder 32 of the over-running clutch 31 does not have to have a relatively large axial dimension, whereby the axially shortened clutch inner cylinder 32 does not require a troublesome precision finishing of the inner surface of the clutch inner cylinder 32 and two bearings which increase the cost of the starter. Instead, the clutch inner cylinder 32 can be effectively supported by a single bearing 32*a***.

What is claimed is:

1. An engine starter motor, comprising:

a d.c. motor having a yoke, an armature with an armature rotary shaft (7) and front and rear brackets rotatably supporting said armature rotary shaft;

an over-running clutch (31) axially slidably mounted on said armature rotary shaft for movement between a forward position and a rearward position, and including a clutch inner cylinder (32);

a pinion mounted on said clutch inner cylinder;

a solenoid switch for energizing said d.c. motor and for sliding said over-running clutch together with said pinion between said forward and rearward positions; and a shift lever (34) having a main body, a first end portion operatively coupled to said solenoid switch and a second end portion operatively coupled to said over-running clutch, respectively, said second end portion of said shift lever being bifurcated into two tines (34*e*), each of said tines having a forwardly extending arm (34*f*) disposed substantially parallel to said rotary shaft and an engagement projection (34*g*) extending radially inwardly from a forwardmost end of said arm for engagement with said over-running clutch, wherein each of said arms has an axial length (L1) such that said projections engage said clutch at a position forwardly remote from the main body of the shift lever by a distance substantially corresponding to said axial length, and an axial dimension of said clutch inner cylinder is decreased by said distance.

2. An engine starter motor as claimed in claim 1, wherein said clutch inner cylinder is rotatably supported by a single bearing.

* * * * *